US010227677B2

(12) United States Patent
Kaminaka et al.

(10) Patent No.: US 10,227,677 B2
(45) **Date of Patent: *Mar. 12, 2019**

(54) TITANIUM ALLOY

(75) Inventors: Hideya Kaminaka, Tokyo (JP); Yoshihisa Yonemitsu, Tokyo (JP); Satoshi Matsumoto, Tokyo (JP); Kouichi Takeuchi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/234,475

(22) PCT Filed: Jul. 20, 2012

(86) PCT No.: PCT/JP2012/004621

§ 371 (c)(1),
(2), (4) Date: Jan. 23, 2014

(87) PCT Pub. No.: WO2013/014894

PCT Pub. Date: Jan. 31, 2013

(65) Prior Publication Data

US 2014/0161660 A1 Jun. 12, 2014

(30) Foreign Application Priority Data

Jul. 26, 2011 (JP) ..... 2011-162814
Nov. 28, 2011 (JP) ..... 2011-258961

(51) Int. Cl.
*C22C 14/00* (2006.01)
*C22F 1/18* (2006.01)
*C22F 1/02* (2006.01)

(52) U.S. Cl.
CPC ..... *C22C 14/00* (2013.01); *C22F 1/02* (2013.01); *C22F 1/183* (2013.01)

(58) Field of Classification Search
CPC ..... C22C 12/00; C22C 14/00; C22F 1/183
(Continued)

(56) References Cited

U.S. PATENT DOCUMENTS 4,129,438 A 12/1978 Bomberger, Jr.
4,859,415 A 8/1989 Shida et al.
(Continued)

FOREIGN PATENT DOCUMENTS

JP 62-107040 5/1987
JP 62-107041 5/1987
(Continued)

OTHER PUBLICATIONS

Miyuki Hideaki et al., "Low Alloy . . . Resistance, SMI-ACE", The Society of Materials Science, Committee on Corrosion and Protection, Sep. 12, 2001, and it's brief English translation.

*Primary Examiner* — Keith Walker
*Assistant Examiner* — John A Hevey
(74) *Attorney, Agent, or Firm* — Clark & Brody

(57) ABSTRACT

A titanium alloy including by mass %, a platinum group metal: 0.01 to 0.15% and a rare earth metal: 0.001 to 0.10%, with the balance being Ti and impurities. The titanium alloy preferably includes as a partial replacement for Ti, Co: 0.05 to 1.00% by mass, and the content of the platinum group metal is preferably in the range of 0.01 to 0.05% by mass. Furthermore, it is preferred that the platinum group metal be Pd and the rare earth metal be Y. Consequently, it is possible to provide a titanium alloy having corrosion resistance comparable to or better than that of the conventional art as well as good workability while offering an economic advantage with a lower content of platinum group metal or an advantage of less likelihood of corrosion growth originating at defects such as flaws that occurred in the surface.

4 Claims, 5 Drawing Sheets

(58) Field of Classification Search
USPC ..... 420/417
See application file for complete search history.

(56) References Cited

U.S. PATENT DOCUMENTS

| | | | | | |
|---|---|---|---|---|---|
| 4,923,770 | A | | 5/1990 | Grasselli et al. | |
| 5,091,148 | A | * | 2/1992 | Prasad | 420/417 |
| 5,141,566 | A | | 8/1992 | Kitayama et al. | |
| 5,478,524 | A | * | 12/1995 | Nakanose et al. | 420/417 |
| 5,683,523 | A | | 11/1997 | Nakanose et al. | |
| 2014/0255816 | A1 | * | 9/2014 | Kaminaka et al. | 429/465 |
| 2015/0240332 | A1 | * | 8/2015 | Kaminaka | C22F 1/183 420/421 |

FOREIGN PATENT DOCUMENTS

| | | | | | |
|---|---|---|---|---|---|
| JP | 64-21040 | | | 1/1989 | |
| JP | 03097820 | A | * | 4/1991 | C22C 14/00 |
| JP | 04-57735 | | | 9/1992 | |
| JP | 06-64600 | | | 3/1994 | |
| JP | 06-65661 | | | 3/1994 | |
| JP | 06-307545 | | | 11/1997 | |
| WO | 2007/077645 | | | 7/2007 | |

* cited by examiner (a)

(b)

TITANIUM ALLOY

TECHNICAL FIELD

The present invention relates to a titanium alloy, and in particular to a titanium alloy that exhibits high corrosion resistance, e.g., crevice corrosion resistance and acid resistance while having good workability and economic advantages. The present invention also relates to a titanium alloy that exhibits high corrosion resistance and good workability with less likelihood of corrosion growth originating at defects such as flaws.

BACKGROUND ART

Titanium has been actively utilized in fields such as the aircraft industry because of its characteristics of being light and strong. Also, because of its high corrosion resistance, titanium is increasingly being utilized in a variety of applications such as construction materials for chemical plants, thermal and nuclear power plants, and seawater desalination plants.

However, although titanium is noted for its good corrosion resistance, the high corrosion resistance was exhibited only in limited environments such as oxidizing acid (nitric acid) environments and neutral chloride environments, e.g., a sea water environment. It was not capable of exhibiting sufficient crevice corrosion resistance in high temperature chloride environments or sufficient corrosion resistance in a non-oxidizing acidic solution such as hydrochloric acid (hereinafter also collectively referred to as "corrosion resistance").

In order to solve the above-described problem, titanium alloys formed with a platinum group metal added to titanium have been proposed, and a number of standardized products including ASTM grade 7 and ASTM grade 17 are being used in a variety of applications.

Specifically, in the chlor-alkali industry, as a material for the anode in electrolysis, titanium alloys are used for portions where crevice corrosion may occur due to the use in a chlorine containing hot concentrated brine, e.g., a 20 to 30 percent brine having a temperature of 100° C. or higher.

Also, in the nickel or lead refining industry, titanium alloys are used as a material for reaction vessels or pipes that are exposed to a slurry containing hot concentrated sulfuric acid solution at a temperature exceeding 100° C.

Furthermore, in the field of heat exchangers, titanium alloys are used, for example, in heat exchanger tubes for salt production that are exposed to a hot concentrated brine, and heat exchanger tubes for use in incinerators for heat exchange with the exhaust gas containing chlorine, nitrogen oxides, and sulfur oxides.

In the petrochemical industry, titanium alloys are used, for example, in desulfurization reactors that are exposed to crude oil, hydrogen sulfide, ammonium chloride, or the like at elevated temperatures exceeding 100° C. during petroleum refining.

As an alloy having improved corrosion resistance for the above-mentioned applications, a Ti-0.15Pd alloy (ASTM grade 7) was developed. This titanium alloy takes advantage of the phenomenon that Pd, included in the alloy, lowers the hydrogen overvoltage and thus results in maintaining the spontaneous potential within the passivation range potential. That is, deposition and buildup of Pd leached from the alloy by corrosion causes lowering of hydrogen overvoltage to thereby maintain the spontaneous potential within the passivation range potential and achieve high corrosion resistance.

However, since ASTM grade 7 having high corrosion resistance contains Pd, which is a platinum group metal and very expensive (2200 Japanese yen per gram according to the morning edition of the Nihon Keizai Shimbun dated Feb. 9, 2011), its fields of use have been limited.

In order to solve this problem, a titanium alloy having a reduced Pd content of 0.03 to 0.1% by mass (ASTM grade 17) has been proposed and put into practical use as disclosed in Patent Literature 1. Despite the reduced Pd content as compared to that of ASTM grade 7, ASTM grade 17 exhibits high crevice corrosion resistance.

Patent Literature 2 discloses a titanium alloy that is capable of being manufactured at a reduced cost while its corrosion resistance is prevented from decreasing. The titanium alloy of Patent Literature 2 contains 0.01 to 0.12% by mass in total of at least one of platinum group metals and 5% or less by mass of at least one of Al, Cr, Zr, Nb, Si, Sn and Mn. In typical applications, titanium alloys exhibit adequate properties such as corrosion resistance if Pd is present in an amount of 0.01 to 0.12% by mass. However, to meet the need for further improvement in properties in recent years, the Pd content, particularly when reduced to less than 0.05%, is not sufficient for a titanium alloy to exhibit adequate properties such as corrosion resistance. Moreover, even in typical applications, the demand for further cost savings is increasing.

Patent Literatures 3 and 4 disclose titanium alloys containing a combination of a platinum group metal, a rare earth metal, and a transition metal, as inventions belonging to different fields of art from that of the present invention. These inventions relate to an ultra high vacuum chamber and a titanium alloy for use in ultra high vacuum chambers, respectively.

In these inventions, the addition of a platinum group metal and a rare earth metal is intended to achieve the advantage of inhibiting, in ultra high vacuum environment, the diffusion and release of the gas components forming a solid solution in the material into the vacuum. These patent literatures state that the platinum group metal acts to trap hydrogen and the rare earth element acts to trap oxygen in the titanium alloy.

Furthermore, these inventions specify, as an essential element, a transition metal selected from the group consisting of Co, Fe, Cr, Ni, Mn, and Cu in addition to the platinum group metal and the rare earth metal. These patent literatures state that the transition metal acts to fix the hydrogen atoms adsorbed on the surface of the vacuum chamber by the platinum group metal. However, it is not clear whether or not the titanium alloys of Patent Literatures 3 and 4 have corrosion resistance because there are no disclosures or suggestions in this regard.

Non-Patent Literature 1 states that Pd must be present in an amount of 0.05% or more by mass to ensure the crevice corrosion resistance of a Ti—Pd alloy, and that addition of Co, Ni, or V as a third element improves the crevice corrosion resistance.

As described above, conventional art techniques are becoming less adequate to meet the need for further improvement in properties if the Pd content is below 0.05% by mass.

Furthermore, even a Ti—Pd alloy with a Pd content of 0.05% or more by mass had a problem in that when defects such as flaws occur in the surface due to the service environment, corrosion originating at the defects is likely to develop.

CITATION LIST

Patent Literature

PATENT LITERATURE 1: Japanese Patent Publication No. H04-57735

PATENT LITERATURE 2: International Publication No. WO2007/077645

PATENT LITERATURE 3: Japanese Patent Application Publication No. H06-64600

PATENT LITERATURE 4: Japanese Patent Application Publication No. H06-65661

Non-Patent Literature

Non-Patent Literature 1: The Society of Materials Science, Committee on Corrosion and Protection, "Low Alloy Titanium Having Good Crevice Corrosion Resistance, SMI-ACE", Sep. 12, 2001.

SUMMARY OF INVENTION

Technical Problem

The present invention has been made in view of the foregoing problems. Accordingly, an object of the present invention is to provide a titanium alloy having corrosion resistance comparable to or better than that of the conventional art as well as good workability, and also having economic advantages afforded by a reduced content of a platinum group metal such as Pd as compared to the conventional art. Another object of the invention is to provide a titanium alloy that has a Pd content similar to that of the conventional art but has advantages of corrosion resistance comparable to or better than that of the conventional art and good workability, and what is more, less likelihood of corrosion growth originating at defects such as flaws that occurred in the surface.

Solution to Problem

In order to achieve the above object, the present inventors have developed a better understanding of the mechanism for improvement of the corrosion resistance of a Ti—Pd alloy, and conducted studies on the following: enhancing the corrosion resistance of a Ti—Pd alloy by including a non-conventional element that facilitates achievement of desirable surface conditions for improved corrosion resistance; and achieving corrosion resistance comparable to or better than that of the conventional art with a reduced Pd content as compared to that of the conventional art.

In this regard, the present invention differs from the conventional art techniques designed to achieve enhanced corrosion resistance of a titanium alloy by supplementarily including additional elements that are effective in improving corrosion resistance as described in Patent Literature 2 and Non-Patent Literature 1.

FIG. 1 is a schematic diagram illustrating a mechanism for improvement of the corrosion resistance of a Ti—Pd (—Co) alloy. A Ti—Pd alloy as well as a Ti—Pd—Co alloy is in the active sate in their initial condition. When immersed in an acid solution such as boiling hydrochloric acid, Ti and Pd, or Ti, Pd and Co in the surface are dissolved, and the dissolved Pd, or the dissolved Pd and Co are deposited onto the surface and accumulated thereon to thereby lower the hydrogen overvoltage of the entire alloy. This allows the alloy to be held in the passivation range potential and thus exhibit good corrosion resistance.

In order to ensure that Pd is deposited and accumulated quickly and uniformly on the surface after the Ti—Pd alloy has been immersed in an acid solution, the present inventors searched for elements that facilitate dissolution of the alloy matrix that occurs at an early stage after the immersion in the solution.

The following assumptions were made. If the presence of a non-conventional element included in the alloy causes the alloy matrix to be dissolved at an early stage after the immersion in the acid solution, an increase in Pd ion concentration in the solution near the outermost surface may occur and therefore an adequate amount of Pd deposition and accumulation may be achieved rapidly ("adequate amount" herein means a greater amount of Pd than the case where the non-conventional element is not present). If this Pd deposition and accumulation is achieved, the hydrogen overvoltage of the Ti—Pd alloy may decrease rapidly even when the Pd content is low and thus allow a shift to a more noble and stable potential (passivation range potential).

In the case of a Ti—Pd alloy with a low Pd content, rapid dissolution of the alloy matrix may be achieved in the early-stage active state by including such non-conventional element. If this occurs, the Pd and Ti ion concentrations near the surface should be increased as compared to the case where such element is not included so that deposition and accumulation of Pd occurs. Because of this, the hydrogen overvoltage of the alloy should decrease rapidly to thereby allow the alloy to be held in the passivation range potential.

On the other hand, if dissolution of the alloy matrix is not facilitated in an Ti—Pd alloy with a low Pd content, the Pd and Ti ion concentrations near the surface may not be increased and the leached Pd may be diffused. Thus, the deposition of Pd may be less likely to occur, which may result in poor corrosion resistance.

In the meantime, in the case of a Ti—Pd alloy with a high Pd content, even if surface defects such as flaws occur in its service environment, the presence of the non-conventional element may enable rapid deposition and accumulation of Pd on the fresh surface resulting from the defects. This should allow the hydrogen overvoltage of the alloy to shift to the passivation range potential, and therefore should result in the healing of the defects. Thus, the advantage of less likelihood of corrosion growth originating at defects should be achieved.

Based on the above assumptions, the present inventors have carried out experiments to search for elements that facilitate dissolution of the alloy matrix that occurs at an early stage after immersion in the solution, i.e., elements that facilitate deposition and accumulation of Pd on the Ti—Pd alloy surface. As a result, they have found rare earth metals are the element that satisfies the need.

The present invention has been accomplished based on this finding, and the summaries thereof are set forth below in items (1) to (5) relating to titanium alloys.

(1) A titanium alloy including by mass %, a platinum group metal: 0.01 to 0.15% and a rare earth metal: 0.001 to 0.10%, with the balance being Ti and impurities.

(2) The titanium alloy according to the above item (1) wherein Co is included, as a partial replacement for Ti, in an amount of 0.05 to 1.00% by mass, and wherein the rare earth metal is present in an amount of 0.001 to less than 0.02% by mass.

(3) The titanium alloy according to the above item (1) or (2), wherein the platinum group metal is present in an amount of 0.01 to 0.05% by mass.

(4) The titanium alloy according to any one of the above items (1) to (3), wherein the platinum group metal is Pd.

(5) The titanium alloy according to any one of the above items (1) to (4), wherein the rare earth metal is Y.

In the description below, terms "% by mass" and "ppm by mass" used in relation to the titanium alloy composition are simply referred to as "%" and "ppm," respectively, unless otherwise noted.

Advantageous Effects of Invention

The titanium alloy of the present invention has high corrosion resistance and good workability. Because of this, with the use of the titanium alloy of the present invention, it is possible to enhance performance and reliability of equipment and machinery that are used in corrosive environments (particularly in hot concentrated chloride environments). When a platinum group metal is included in relatively small amounts, it provides an advantage of more economical material costs for producing such titanium alloys. When a platinum group metal is included in relatively large amounts, it provides an advantage of less likelihood of corrosion growth originating at defects such as flaws that occurred in the surface.

BRIEF DESCRIPTION OF DRAWINGS

FIG. 9(*b*) is a graph illustrating the relationship between the surface Pd concentration after the test and the Y content.

DESCRIPTION OF EMBODIMENTS

Figure 1:
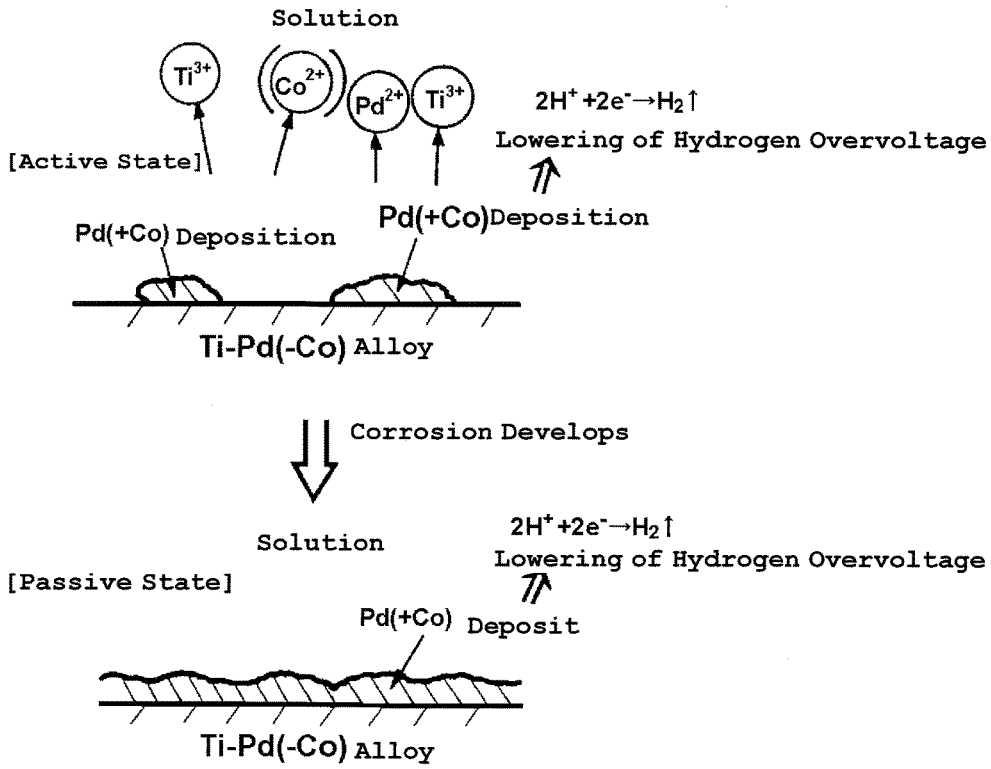
FIG. 1 is a schematic diagram illustrating a mechanism for improvement of the corrosion resistance of a Ti—Pd (—Co) alloy.

As described above, the titanium alloy of the present invention includes by mass %, a platinum group metal: 0.01 to 0.15% and a rare earth metal: 0.001 to 0.10%, with the balance being Ti and impurities. The details of the present invention are set out below.

1. Composition Range of Titanium Alloy and Reasons for Limitations

1-1. Platinum Group Metal

The platinum group metal as used herein refers to Ru, Rh, Pd, Os, Ir, and Pt. Platinum group metals produce the advantageous effect of lowering the hydrogen overvoltage of a titanium alloy and maintaining the spontaneous potential in the passivation range potential, and therefore are an essential component for a titanium alloy having corrosion resistance. The titanium alloy of the present invention includes one or more of the platinum group metals. The total content of the one or more of the platinum group metals (hereinafter simply referred to as "content of the platinum group metals") is in the range of 0.01 to 0.15%. This is because if the content of platinum group metals is less than 0.01%, the alloy exhibits inadequate corrosion resistance and thus may suffer corrosion attack in a hot concentrated chloride solution. Meanwhile, a content of platinum group metals exceeding 0.15% does not offer any further improvement in corrosion resistance while requiring an enormous material cost.

For use in conventional applications, the content of platinum group metals preferably ranges from 0.01 to 0.05% in light of balance between the economic advantage and corrosion resistance. This is because, even with this range of platinum group metal content, the titanium alloy of the present invention exhibits corrosion resistance comparable to that of conventional titanium alloys having a platinum group metal content higher than 0.05%.

In the meantime, when flaws or the like occur in a titanium alloy, the higher the content of the platinum group metals, the more rapidly deposition and accumulation of the platinum group metals progresses in the fresh surface resulting from the flaws or the like as described above taking a Ti—Pd alloy as an example. That is, the higher the content of the platinum group metals, the more rapidly the potential at the site of flaw (or the like) initiation shifts to the passivation range potential to allow restoration of the surface, which results in less likelihood of corrosion attack originating at the flaws or the like. Thus, even when a platinum group metal is contained in the range of 0.05 to 0.15%, there is also a benefit in terms of suitability for use in severe service environments.

In the present invention, Pd is most preferred among the platinum group metals, Ru, Rh, Pd, Os, Ir, and Pt because Pd is relatively inexpensive and capable of providing high degree of improvement in corrosion resistance per amount. Rh and Pt are economically disadvantageous because they are very expensive. Ru and Ir are somewhat less expensive than Pd and may be used as substitutes for Pd. However, their output is not as high as that of Pd, and therefore Pd, which is stably available, is preferred.

1-2. Rare Earth Metal

1-2-1. Reasons for Inclusion of Rare Earth Metal

The present inventors have studied the possibility of forming a Ti-0.02Pd alloy by including therein a trace amount of an element that is readily soluble in hot concentrated chloride environments. To discover the effect produced by such element, they conducted research by immersing a titanium alloy formed with a possibly effective element in a chloride solution and having them dissolved in the activation potential, and examined the effect of shifting the entire alloy to the passivation range potential by facilitating deposition and accumulation of a platinum group metal on the surface. As a result of research on a variety of elements, rare earth elements were found to be capable of producing this effect.

As described above, the content of a platinum group metal is preferably in the range of 0.01 to 0.05%. After further research, they have found that the same effect can be produced when the platinum group metal content is greater than 0.05%. That is, if a rare earth metal is included in a platinum group metal-containing titanium alloy having a platinum group metal content greater than 0.05% as with the case of the platinum group metal-containing alloy having a platinum group metal content of 0.01 to 0.05%, rapid dissolution of Ti and the platinum group metal occurs at an early stage after being exposed to a corrosive environment. Thus, the platinum group metal ion concentration near the outermost surface of the titanium alloy is increased to thereby allow rapid deposition and accumulation of the platinum group metal on the surface of the titanium alloy. As such, a platinum group metal-containing titanium alloy formed with a rare earth metal is capable of causing deposition of a platinum group metal on the surface more efficiently than a platinum group metal-containing titanium alloy that does not contain a rare earth metal. Therefore it exhibits high corrosion resistance by allowing efficient deposition of a platinum group metal even if the amount of corrosion of the entire titanium alloy is small. Furthermore, a platinum group metal-containing titanium alloy formed with a rare earth metal is capable of maintaining its corrosion resistance even in environments more severe than conventionally experienced. For example, when used in a plant or the like that uses a hot concentrated chloride solution, even if a platinum group metal deposited on the surface are removed due to wear or the like, or even if surface defects such as flaws occur as described above, this titanium alloy is capable of restoring the surface by allowing rapid deposition and accumulation of the platinum group metal, and therefore maintaining its corrosion resistance.

Rare earth metals include Sc, Y, light rare earth elements (La to Eu), and heavy rare earth elements (Gd to Lu). According to the results of the studies by the present inventors, all the rare earth metals were found to be effective. Furthermore, it is not required that only one of the rare earth metals be included. Use of a mixture of rare earth metals such as mixed rare earth metals before separation and refinement (misch metal, hereinafter also referred to as "Mm") or a didymium (a mixture of Nd and Pr) were also found to be effective. Therefore preferred rare earth metals from the economic standpoint are La, Ce, Nd, Pr, Sm, Mm, didymium, Y, and the like for their availability and relative inexpensiveness. As for the compositions of Mm and didymium, any composition ratios are applicable as long as commercially available materials are used.

1-2-2. Content of Rare Earth Metal

In the titanium alloy of the present invention, the content of rare earth metals ranges from 0.001 to 0.10%. The reason for the lower limit of 0.001% of the rare earth metal content is to sufficiently produce the advantageous effect of facilitating deposition of Pd on the alloy surface by making sure that Ti, Pd, and a rare earth metal are dissolved simultaneously in a chloride solution in the activation potential of the Ti—Pd alloy.

The reason for the upper limit of 0.10% of the rare earth metal content is that an excessively high amount of rare earth metal in a Ti—Pd alloy can produce a new compound within the Ti alloy. This new compound preferentially dissolves in a chloride solution, and therefore leads to initiation of pitting corrosion in the Ti—Pd alloy. Because of this, Ti—Pd alloys having this compound exhibit inferior corrosion resistance as compared to Ti—Pd alloys containing no rare earth metals. Furthermore, it is preferred that the rare earth metal content in a Ti—Pd alloy be not more than its solid solubility limit in α-Ti as shown in a phase diagram or the like.

For example, the solid solubility limit of Y in α-Ti of a Ti-0.02Pd alloy is 0.02% by mass (0.01 at %). Therefore, when Y is included, its content is preferably less than 0.02% by mass.

The Y content of less than 0.02% is sufficient in terms of facilitating accumulation of a platinum group metal on the titanium alloy surface while greater advantages are achieved if the Y content is limited to 0.01% or less.

La has a very large solubility limit, in α-Ti of a Ti-0.02Pd alloy, at 2.84% by mass (1 at %) (T. B. Massalski, "Binary Alloy Phase Diagrams Volume 3," the United States, Second Edition, ASM International, 1990, pg. 2432). However, in terms of ensuring economic advantages, La, when included, is contained in an amount of 0.10% or less by mass.

As is the case with Y, a sufficient content of La is less than 0.02% in terms of facilitating accumulation of platinum group metals on the titanium alloy surface while greater advantages are achieved if its content is limited to 0.01% or less.

1-3. Addition of Co in Combination with Rare Earth Metal

The titanium alloy of the present invention may include Co, as a partial replacement for Ti, in an amount of 0.05 to 1%. Co is an element that enhances crevice corrosion resistance of a titanium alloy. The present inventors have found that including Co as a partial replacement for Ti, in a platinum group metal-containing titanium alloy formed with a rare earth metal, results in higher corrosion resistance due to the synergy with the rare earth metal.

To produce the synergy, Co must be present in an amount of 0.05% or more. In the meantime, if the Co content exceeds 1%, intermetallic compounds of $AB_5$ type (A=rare earth metal, B=Co) are produced by the rare earth metal and Co, which results in a decrease in corrosion resistance of the titanium alloy. This is the reason for specifying the Co content of 0.05 to 1%.

1-4. Ni, Mo, V, Cr and W

The titanium alloy of the present invention may include Ni, Mo, V, Cr, and W as partial replacements for Ti. Including these elements results in high crevice corrosion resistance due to the synergy with the rare earth metal. When these elements are included, their contents are, Ni: 1.0% or less, Mo; 0.5% or less, V: 0.5% or less, Cr: 0.5% or less, and W: 0.5% or less.

1-5. Impurity Elements

Impurity elements in a titanium alloy include, by way of example, Fe, O, C, H, N, and the like entering from raw materials, a dissolving electrode and the environment as well as Al, Cr, Zr, Nb, Si, Sn, Mn, Cu, and the like introduced when scraps or the like are used as materials. Introduction of these impurity elements is of no matter as long as it does not adversely affect the advantages of the present invention. Specifically, the compositional range not adversely affecting the advantages of the present invention is as follows, Fe: 0.3% or less, O: 0.35% or less, C: 0.18% or less, H: 0.015% or less, N: 0.03% or less, Al: 0.3% or less, Cr: 0.2% or less, Zr: 0.2% or less, Nb: 0.2% or less, Si: 0.02% or less, Sn: 0.2% or less, Mn: 0.01% or less, and Cu: 0.1% or less, with the total of these being 0.6% or less.

Example 1

To confirm the crevice corrosion resistance and hot (boiling) hydrochloric acid resistance of the titanium alloys of the present invention, the following tests were conducted and the results were evaluated.

1. Test Conditions

1-1. Samples

1-1-1. Titanium Alloys of Conventional Examples

The titanium alloys of Conventional Examples 1 to 3 were prepared from commercially available 4 mm thick sheets of Ti—Pd alloy purchased from a market. Types and analysis values of the elemental compositions of the purchased materials are shown in Table 1. Conventional Example 1 is ASTM grade 7; Conventional Example 2 is ASTM grade 17; and Conventional Example 3 is ASTM grade JIS Class 19 (ASTM grade 30). Conventional Examples 4 and 5 are Ti—Pd alloys having a Pd content close to the lower limit of the range disclosed in Patent Literature 1. Conventional Examples 1 to 5 are all an example of a Ti—Pd alloy containing no rare earth metal. Conventional Examples 1 and 2 serve as benchmarks for the inventive examples that are discussed later.

TABLE 1

| | Alloy Composition (mass %, balance being Ti and impurities) | | | | | | |
|---|---|---|---|---|---|---|---|
| Classification | Rare Earth Metal | Platinum Group Metal | Co | Fe | O | Al | Remarks |
| Inventive Example 1 | Y: 0.02 | Pd: 0.15 | — | — | — | — | |
| Inventive Example 2 | Y: 0.02 | Pd: 0.11 | — | — | — | — | |
| Inventive Example 3 | Y: 0.02 | Pd: 0.05 | — | — | — | — | |
| Inventive Example 4 | Y: 0.02 | Pd: 0.02 | — | — | — | — | |
| Inventive Example 5 | Y: 0.02 | Pd: 0.01 | — | — | — | — | |
| (Comparative Example 3) | Y: 0.02 | Pd: 0.004 | — | — | — | — | |
| Inventive Example 6 | Y: 0.02 | Pd: 0.02 | 1.0 | — | — | — | |
| Inventive Example 7 | Y: 0.02 | Pd: 0.02 | 0.5 | — | — | — | |
| (Comparative Example 1) | Y: 0.12 | Pd: 0.02 | | | | | |
| (Inventive Example 4) | Y: 0.02 | Pd: 0.02 | — | — | — | — | |
| Inventive Example 8 | Y: 0.01 | Pd: 0.02 | — | — | — | — | |
| Inventive Example 9 | Y: 0.003 | Pd: 0.02 | — | — | — | — | |
| (Comparative Example 2) | Y: 4 ppm | Pd: 0.02 | — | — | — | — | |
| (Comparative Example 5) | — | Pd: 0.02 | — | — | — | — | |
| Inventive Example 10 | Y: 0.10 | Pd: 0.03 | — | — | — | — | |
| Inventive Example 11 | Dy: 0.10 | Pd: 0.03 | — | — | — | — | |
| Inventive Example 12 | La: 0.08 | Pd: 0.03 | — | — | — | — | |
| Inventive Example 13 | Didymium: 0.04 | Pd: 0.03 | — | — | — | — | |
| Inventive Example 14 | Pr: 0.03 | Pd: 0.03 | — | — | — | — | |
| Inventive Example 15 | Ce: 0.09 | Pd: 0.02 | — | — | — | — | |
| Inventive Example 16 | Mm: 0.05 | Pd: 0.02 | — | — | — | — | |
| Inventive Example 17 | Nd: 0.05 | Pd: 0.02 | 0.2 | — | — | — | |
| Inventive Example 18 | Sm: 0.06 | Pd: 0.01 | 0.3 | — | — | — | |
| Inventive Example 19 | Y: 0.02 | Ru: 0.04 | — | — | — | — | PGM: Ru |

TABLE 1-continued

| Classification | Alloy Composition (mass %, balance being Ti and impurities) | | | | | | Remarks |
|---|---|---|---|---|---|---|---|
| | Rare Earth Metal | Platinum Group Metal | Co | Fe | O | Al | |
| (Comparative Example 8) | — | Ru: 0.04 | — | — | — | — | PGM: Ru |
| Comparative Example 1 | Y: 0.12 | Pd: 0.02 | — | — | — | — | REM: outside the specified range |
| Comparative Example 2 | Y: 4 ppm | Pd: 0.02 | — | — | — | — | REM: outside the specified range |
| Comparative Example 3 | Y: 0.02 | Pd: 0.004 | — | — | — | — | PGM: outside the specified range |
| Comparative Example 4 | La: 0.10 | Pd: 0.03 | 1.2 | — | — | — | Co content: outside the specified range |
| Comparative Example 5 | — | Pd: 0.02 | — | — | — | — | No REM |
| Comparative Example 6 | Y: 0.01 | — | — | — | — | — | No PGM |
| Comparative Example 7 | — | — | — | — | — | — | JIS Class 1 Ti |
| Comparative Example 8 | — | Ru: 0.04 | — | — | — | — | PGM: Ru |
| Conventional Example 1 | — | Pd: 0.14 | — | 0.073 | 0.109 | — | ASTM grade 7 |
| Conventional Example 2 | — | Pd: 0.06 | <0.01 | 0.036 | 0.07 | — | ASTM grade 17 |
| Conventional Example 3 | — | Pd: 0.06 | 0.31 | 0.042 | 0.103 | — | JIS Class 19 |
| Conventional Example 4 | — | Pd: 0.03 | — | 0.08 | 0.07 | — | Patent Literature 1 |
| Conventional Example 5 | — | Pd: 0.02 | — | 0.04 | 0.102 | 2 | Patent Literature 2 (Example 4) |

1-1-2. Samples of Inventive Examples and Comparative Examples

The titanium alloys of the inventive examples and comparative examples were prepared using sheet materials having elemental compositions as shown in Table 1.

1-1-2-1. Materials of the Samples

Titanium alloys of the inventive examples and comparative examples were prepared using, as materials, commercially available industrial pure titanium sponge (JIS class 1), a palladium (Pd) powder manufactured by KISHIDA CHEMICAL Co., Ltd. (99.9% pure), a ruthenium (Ru) powder manufactured by KISHIDA CHEMICAL Co., Ltd. (99.9% pure), yttrium (Y) chips manufactured by KISHIDA CHEMICAL Co., Ltd. (99.9% pure), a rare earth metal ingot, and an electrolytic cobalt (Co) ingot (99.8% pure). The rare earth metals used were Mm, La, Nd, Ce, Dy, Pr, Sm and didymium, all of which, except Mm and didymium, were 99% pure. Mm is composed of La: 28.6%, Ce: 48.8%, Pr: 6.4%, and Nd: 16.2%, and didymium is composed of Nd: 70.1% and Pr: 29.9%.

The titanium alloys of Inventive Examples 1 to 18 all have a composition specified by the present invention. Among these, Inventive Examples 6, 7, 17 and 18 contain a rare earth metal, Pd and Co, Inventive Example 19 contains Y and Ru without containing a platinum group metal, and the other inventive examples contain a rare earth metal and Pd with no further compositional elements. In Table 1, the symbol "-" indicates that the element was below detection limits.

The titanium alloys of Comparative Examples 1 to 8 all have a composition outside the range specified by the present invention. Comparative Examples 1 and 2 each contain Y and Pd. Comparative Example 1 has a Y content higher than the range specified by the present invention, and Comparative Example 2 has a Y content lower than the range of the present invention. Comparative Example 3 contains Y and Pd, and its Pd content is lower than the range specified by the present invention. Comparative Example 4 contains La, Pd, and Co, and its Co content is higher than the range specified by the present invention. Comparative Examples 5 to 8 each contain only one of a rare earth metal and a platinum group metal, or contain neither of them. Among these, Comparative Example 7 is made of JIS Class 1 titanium.

In Table 1, Inventive Example 4, Comparative Example 3, Comparative Example 5, and Comparative Example 8 are listed in duplicate for ease of comparison.

1-1-2-2. Process for Preparation of Sample

Using an arc melting furnace under argon atmosphere, five ingots, made of the above-mentioned materials, 80 grams each, were melted. Then all the five ingots were combined and remelted to prepare a square ingot with a thickness of 15 mm. The finished square ingot was remelted for homogenization and again formed into a square ingot with a thickness of 15 mm. That is, three stages of melting were performed in total.

Since the square ingots of all examples contain trace quantities of Pd and/or a rare earth metal, a heat treatment for homogenization was applied to reduce segregation of the elements under the following conditions:

Atmosphere: vacuum ($<10^{-3}$ torr);

Temperature: 1100° C.; and

Time: 24 hours.

The square ingots subjected to homogenization heat treatment were rolled under the following conditions and formed into sheet materials with a thickness of 4 mm:

β phase hot rolling: at 1000° C., thickness reduced from 15 mm to 9 mm; and

α+β phase hot rolling: at 875° C., thickness reduced from 9 mm to 4 mm.

The sheet materials obtained from the rolling were stress relief annealed in a vacuum at 750° C. for 30 minutes.

1-2. Test Conditions

Crevice corrosion resistance tests and hot (boiling) hydrochloric acid tests were conducted using specimens taken from the sheet materials purchased from a market or prepared by the above described process.

1-2-1. Crevice Corrosion Resistance Test

Figure 2:
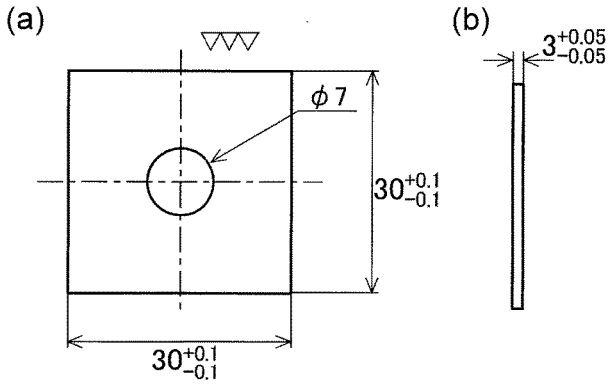
FIG. 2 is a schematic diagram of a specimen for a crevice corrosion resistance test, with FIG. 2(*a*) being a plan view and FIG. 2(*b*) being a side view.

FIG. 2 is a schematic diagram of a specimen for a crevice corrosion resistance test, with FIG. 2(*a*) being a plan view and FIG. 2(*b*) being a side view. A specimen having a thickness of 3 mm, a width of 30 mm, and a length of 30 mm, as shown in the figure, was cut from the sheet material, and provided with a bore having a diameter of 7 mm in its center. This specimen was polished by 600 grit emery paper.

Figure 3:
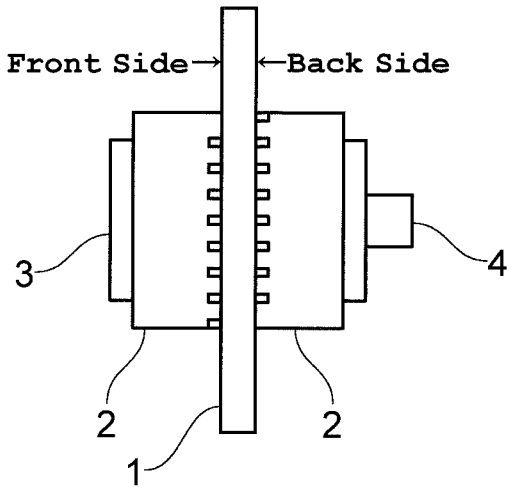
FIG. 3 is a schematic diagram of the specimen when used for the crevice corrosion test (ASTM G78).

FIG. 3 is a schematic diagram of the specimen when used for the crevice corrosion test. The specimen polished with emery paper as shown in the figure was used for a crevice corrosion test in accordance with the multiple crevice test of the ASTM G78 specification. The specimen 1 was held, at both sides thereof, by multiple crevice assemblies 2 pressed thereto and tightened to a torque of 10 kgf-cm using a bolt 3 and a nut 4 made of pure titanium. The multiple crevice assemblies 2 were made of polytrifluoroethylene. They were placed such that their grooved surfaces were in contact with the specimen 1.

The crevice corrosion test was conducted under the following conditions:

Test Environment: 250 g/L NaCl, pH=2 (pH adjusted with HCl), 150° C., saturated atmosphere; and Test Time: 240 hours.

1-2-2. Hot (Boiling) Hydrochloric Acid Test

Figure 4:
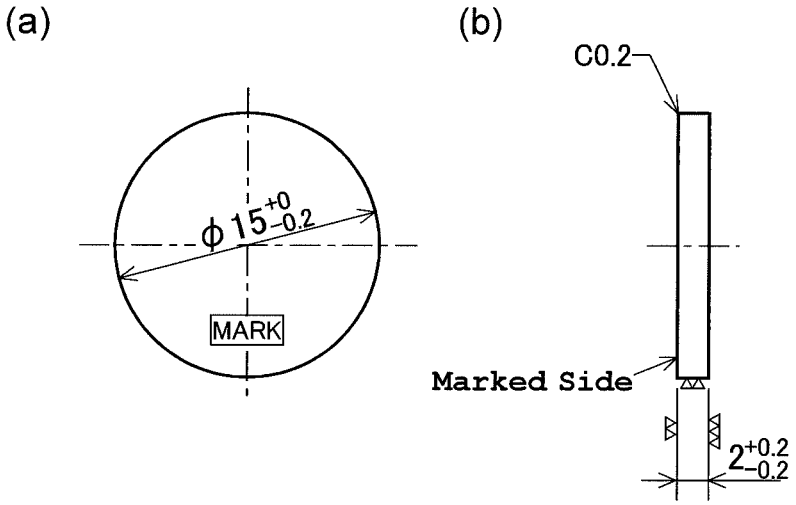
FIG. 4 is a schematic diagram of a specimen for a hot (boiling) hydrochloric acid test, with FIG. 4(*a*) being a plan view and FIG. 4(*b*) being a side view.

FIG. 4 is a schematic diagram of a specimen for a hot (boiling) hydrochloric acid test, with FIG. 4(*a*) being a plan view and FIG. 4(*b*) being a side view. A specimen having a coin shape, with a thickness of 2 mm and a diameter of 15 mm, as shown in the figure, was cut from the sheet material. This specimen was polished by use of 600 grit emery paper. After the specimen was immersed in hot hydrochloric acid under the following conditions, the amount of corrosion (corrosion rate) per unit time was calculated from the reduced mass resulting from corrosion.

The hot (boiling) hydrochloric acid test, which is a corrosion test that simulates the crevice internal environment in crevice corrosion, was conducted under the following conditions. The boiling test vessel was provided with a coiled condenser for cooling and condensing hot vapor back into a liquid to make sure that the concentration of the solution does not change:

Concentration and temperature of the solution: 3% hydrochloric acid (boiling);

pH of the solution: pH≈0 (normal temperature); and

Immersion time: 96 hours.

1-2-3. Investigation into Variation in Pd Concentration Near Titanium Alloy Surface As described above, a rare earth metal included in a Ti—Pd alloy facilitates dissolution of the alloy matrix in a hot concentrated chloride solution environment. This facilitates deposition of Pd on the titanium alloy surface to produce the advantageous effect of shifting the entire alloy to the passivation range potential. Thus, it is assumed that, after the crevice corrosion test, the titanium alloy containing a rare earth metal has a higher Pd concentration on its surface than a titanium alloy containing no rare earth metal. To verify this assumption, the specimens after the 96 hour hot (boiling) hydrochloric acid test were examined as to the variation in Pd concentration versus depth from the outermost surface.

The examination of the Pd concentration was carried out under the following conditions:

Analysis Method: Marcus type RF Glow Discharge Optical Emission Spectroscopy (hereinafter referred to as "GDOES");

Analyzer: HORIBA GD-Profiler 2;

Site Analyzed: 4 mm diameter specimen surface area that was in contact with boiling hydrochloric acid; and Depth: Region up to 250 nm depth from the outermost surface.

2. Test Results

Evaluation was made on the number of crevice sites attacked by corrosion, the mean corrosion rate, and the economic advantage as well as evaluation based on all these factors together. The results are shown in Table 2.

TABLE 2

| | Crevice Corrosion Resistance | Hot (Boiling) Hydrochloric Acid Resistance | | Economic Advantage |
|---|---|---|---|---|
| Classification | Number of Crevice Sites Attacked by Corrosion *1 | First 7-hour mean corrosion rate [mm/year] | 96-hour mean corrosion rate [mm/year] | (Material Cost Considered) *2 |
| Inventive Example 1 | 0 | 0.14 | 0.02 | Δ |
| Inventive Example 2 | 0 | 0.21 | 0.05 | Δ |
| Inventive Example 3 | 0 | 2.18 | 0.14 | Δ |
| Inventive Example 4 | 0 | 3.98 | 0.19 | ○ |
| Inventive Example 5 | 0 | 4.02 | 0.25 | ○ |

TABLE 2-continued

| Classification | Crevice Corrosion Resistance | Hot (Boiling) Hydrochloric Acid Resistance | | Economic Advantage |
|---|---|---|---|---|
| | Number of Crevice Sites Attacked by Corrosion *1 | First 7-hour mean corrosion rate [mm/year] | 96-hour mean corrosion rate [mm/year] | (Material Cost Considered) *2 |
| (Comparative Example 3) | 28 | 9.14 | 3.87 | ○ |
| Inventive Example 6 | 0 | 2.22 | 0.13 | ○ |
| Inventive Example 7 | 0 | 2.38 | 0.17 | ○ |
| (Comparative Example 1) | 8 | 6.12 | 1.74 | ○ |
| (Inventive Example 4) | 0 | 3.98 | 0.19 | ○ |
| Inventive Example 8 | 0 | 4.40 | 0.27 | ○ |
| Inventive Example 9 | 0 | 4.78 | 0.29 | ○ |
| (Comparative Example 2) | 15 | 15.39 | 1.90 | ○ |
| (Comparative Example 5) | 20 | 9.54 | 0.70 | ○ |
| Inventive Example 10 | 0 | 3.11 | 0.18 | ○ |
| Inventive Example 11 | 0 | 3.74 | 0.21 | ○ |
| Inventive Example 12 | 0 | 3.79 | 0.23 | ○ |
| Inventive Example 13 | 0 | 3.87 | 0.22 | ○ |
| Inventive Example 14 | 0 | 3.49 | 0.21 | ○ |
| Inventive Example 15 | 0 | 3.81 | 0.22 | ○ |
| Inventive Example 16 | 0 | 3.91 | 0.24 | ○ |
| Inventive Example 17 | 0 | 2.91 | 0.18 | ○ |
| Inventive Example 18 | 0 | 3.09 | 0.19 | ○ |
| Inventive Example 19 | 0 | 4.12 | 0.28 | ○ |
| (Comparative Example 8) | 11 | 8.35 | 1.82 | ○ |
| Comparative Example 1 | 8 | 6.12 | 1.74 | ○ |
| Comparative Example 2 | 15 | 15.39 | 1.90 | ○ |
| Comparative Example 3 | 28 | 9.14 | 3.87 | ○ |
| Comparative Example 4 | 1 | 4.82 | 1.11 | ○ |
| Comparative Example 5 | 20 | 9.54 | 0.70 | ○ |
| Comparative Example 6 | 40 | 16.20 | 16.60 | ○ |
| Comparative Example 7 | 40 | 4.10 | 4.12 | ○ |
| Comparative Example 8 | 11 | 8.35 | 1.82 | ○ |
| Conventional Example 1 | 0 | 0.21 | 0.04 | Δ |
| Conventional Example 2 | 0 | 4.17 | 0.37 | Δ |
| Conventional Example 3 | 0 | 3.02 | 0.20 | Δ |
| Conventional Example 4 | 7 | 5.38 | 1.68 | ○ |
| Conventional Example 5 | 3 | 6.86 | 1.93 | ○ |

*1 Crevice corrosion resistance: evaluated based on the number of crevice sites attacked by corrosion (the number of crevice corrosion sites of all 40 crevice sites)
*2 Economic advantage: symbol "○" is assigned for Pd content of less than 0.05% or Ru content of 0.04%, and symbol "Δ" is assigned for Pd content of 0.05 to 0.15%

2-1. Crevice Corrosion Resistance

Table 2 includes evaluation of the crevice corrosion resistance indicated by the number of sites attacked by corrosion among 40 crevice sites formed by the multiple crevice assemblies. After the tests conducted under the above conditions, none of the inventive examples (Inventive Examples 1 to 19) and none of Conventional Examples 1 to 3 suffered corrosion attack in any of the 40 crevice sites. Among these examples, Inventive Examples 4 to 18, with a Pd content of less than 0.05%, and Inventive Example 19, with a Ru content of 0.04%, have an economic advantage.

Meanwhile, all the comparative examples (Comparative Examples 1 to 8) and Conventional Examples 4 and 5 suffered corrosion attack. From the results of Conventional Examples 1 to 5, it is seen that if a rare earth metal is not included, a Pd content of about 0.06% is necessary to ensure the crevice corrosion resistance.

2-2. Hot (Boiling) Hydrochloric Acid Test

Since the corrosion rate of Ti—Pd alloys decreases over time, evaluation in the hot (boiling) hydrochloric acid test under the above conditions was made by the use of two indices: the mean corrosion rate for the first 7 hours and the mean corrosion rate during 96 hours after the start of the immersion.

Figure 5:
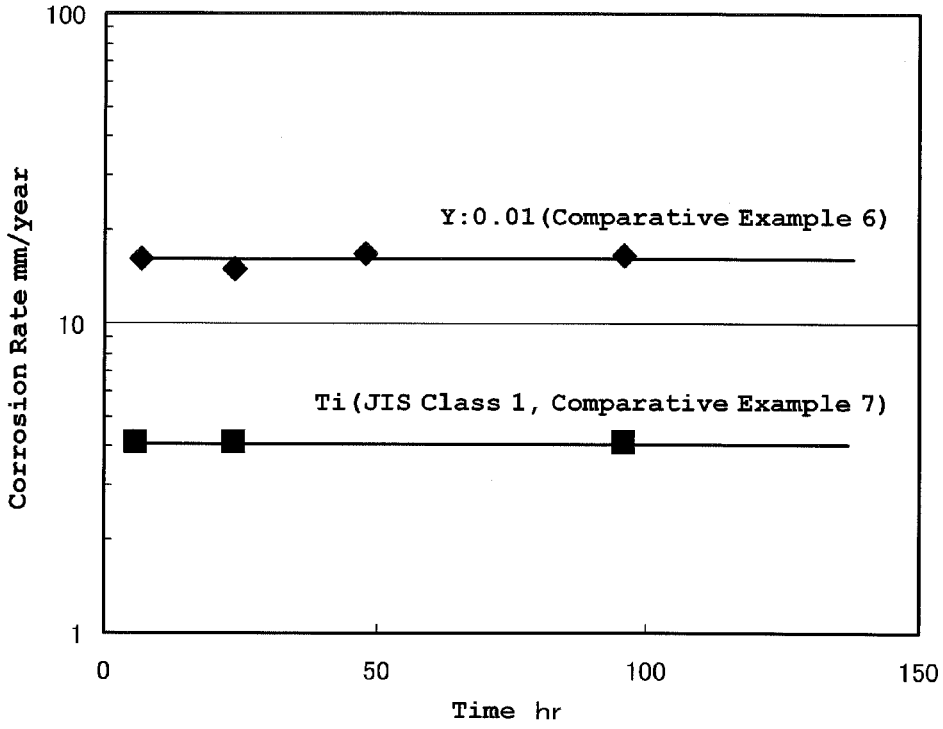
FIG. 5 is a graph illustrating the variations with time in the corrosion rates of Comparative Example 6 and Comparative Example 7 when immersed in a boiling 3% hydrochloric acid solution.
Figure 6:
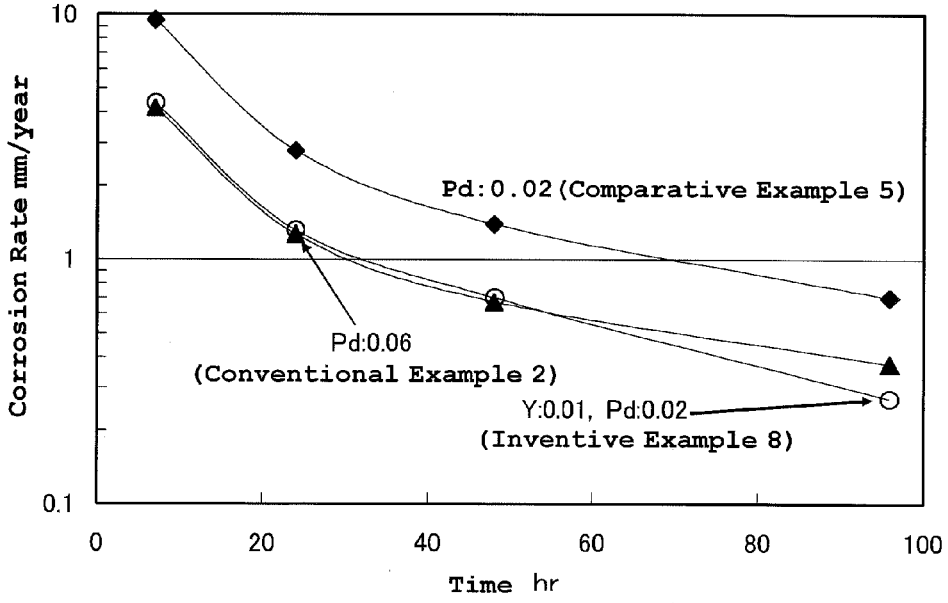
FIG. 6 is a graph illustrating the variations with time in the corrosion rates of Inventive Example 8, Comparative Example 5 and Conventional Example 2 when immersed in a boiling 3% hydrochloric acid solution.

FIG. 5 and FIG. 6 are graphs illustrating the variations with time in the corrosion rates of Comparative Examples 6 and 7, and of Inventive Example 8, Comparative Example 5 and Conventional Example 2, respectively, when immersed in a boiling 3% hydrochloric acid solution. From the figures and the results shown in Table 2, the following findings (1) to (8) were obtained.

(1) The titanium alloys of Comparative Examples 6 and 7, which do not contain Pd, experienced corrosion growth with no decrease in the corrosion rate as shown in FIG. 5. It is assumed that the greater mean corrosion rate of Comparative Example 6 than that of Comparative Example 7 results from the presence of Y which facilitated dissolution of the alloy matrix.

(2) Inventive Examples 1 to 18 had a mean corrosion rate lower than or comparable to that of Conventional Example 2 that serves as a benchmark, both for the first 7 hours and for the 96 hours. Specifically, Conventional Example 2 had mean corrosion rates of 4.17 mm/year and 0.37 mm/year for the first 7 hours and the 96 hours, respectively, whereas Inventive Examples had mean corrosion rates of 5 mm or less/year and 0.3 mm or less/year, respectively. Furthermore, as shown in FIG. 6, Inventive Example 8 with a Y content of 0.01% and a Pd content of 0.02% had a mean corrosion rate comparable to or lower than that of Conventional Example 2 with a Pd content of 0.06%. From FIG. 6, it is also seen that when Y is not included, a higher Pd content leads to a smaller corrosion rate.

(3) A comparison between the results of Inventive Example 1 with a high Pd content of 0.15% and Conventional Example 1, as a benchmark, also with a high Pd content of 0.14%, shows that the presence of Y results in smaller mean corrosion rates both for the first 7 hours and for the 96 hours as well as in better hot (boiling) hydrochloric acid resistance.

(4) A comparison between the results of Inventive Examples 1 to 5 and Comparative Example 3, all having the same Y content of 0.02%, shows that the higher the Pd content, the smaller the mean corrosion rates both for the first 7 hours and for the 96 hours, and the better the hot (boiling) hydrochloric acid resistance.

(5) A comparison between the results of Inventive Example 4, Inventive Example 8, Inventive Example 9, Comparative Example 1, Comparative Example 2, and Comparative Example 5, all having the same Pd content of 0.02%, shows that the higher the Y content, the smaller the mean corrosion rates both for the first 7 hours and for the 96 hours, and the better the hot (boiling) hydrochloric acid resistance. However, a Y content exceeding 0.1% (Comparative Example 1) results in poorer hot (boiling) hydrochloric acid resistance for the reason stated above. In addition, in Comparative Example 5, the mean corrosion rate significantly decreased from 9.54 mm/year for the first 7 hours to 0.70 mm/year for the 96 hours. This indicates that in the absence of a rare earth metal, deposition and accumulation of Pd requires a long time and thus its efficiency is low.

(6) A comparison between the results of Inventive Example 4, Inventive Example 6, and Inventive Example 7, all having the same Y content of 0.02% and Pd content of 0.02%, shows that the higher the Co content, the smaller the mean corrosion rates both for the first 7 hours and for the 96 hours, and the better the hot (boiling) hydrochloric acid resistance.

(7) Inventive Examples 10 to 16 have a Pd content of 0.03% or less and a rare earth metal content of 0.03 to 0.10%, with each example containing a different rare earth metal. It is seen from these results that the presence of any rare earth metal results in smaller mean corrosion rates both for the first 7 hours and for the 96 hours and in better hot (boiling) hydrochloric acid resistance than Conventional Example 2. This means that the presence of a rare earth metal facilitated dissolution of the alloy matrix and thus increased the efficiency of deposition and accumulation of Pd. It is also found that including Y, rather than the other rare earth metals, contributes to better hot (boiling) hydrochloric acid resistance.

(8) A comparison between the results of Inventive Example 19 and Comparative Example 8, both having the same content of Ru, which is a platinum group metal, of 0.04%, shows that Inventive Example 19, which contains Y, exhibits better hot (boiling) hydrochloric acid resistance than Comparative Example 8, which contains no rare earth metal.

2-3. Economic Advantage

The economic advantage shown in Table 2 is evaluation made with consideration of raw material costs, in which the Pd contents of less than 0.05% and the Ru content of 0.04% are assigned the symbol "○" (good) and the Pd contents of 0.05 to 0.15% are assigned the symbol "Δ" (fair).

As shown in Table 2, Inventive Examples 4 to 19 provide an economic advantage, and exhibit high crevice corrosion resistance and hot (boiling) hydrochloric acid resistance. Inventive Examples 1 to 3 were subjected to the hot (boiling) hydrochloric acid test under the above conditions after being provided with flaws on the surface. The results of the test confirm that they suffered no corrosion growth originating at the flaws and thus exhibit very high corrosion resistance. It is also confirmed that the titanium alloys of the inventive examples all have workability comparable to that of pure titanium of Comparative Example 7.

2-4. Investigation into Variation in Pd Concentration Near Titanium Alloy Surface Investigation into variation in Pd concentration near the titanium alloy surface was conducted for Inventive Example 8 and Comparative Example 5. Inventive Example 8 and Comparative Example 5 have the same Pd content of 0.02% while Inventive Example 8 contains Y and Comparative Example 5 does not. As described above, using the specimens after the hot (boiling) hydrochloric acid test as the samples, the surfaces of the specimens were examined as to the concentration profiles, versus depth from the surface, of Pd, Ti and O using the GDOES method.

Figure 7:
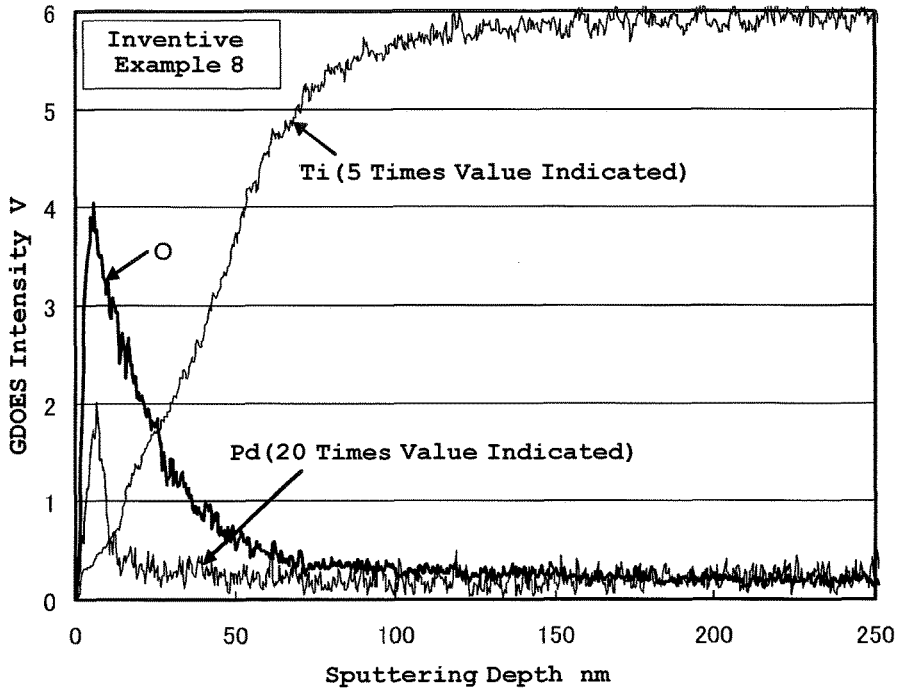
FIG. 7 is a graph illustrating concentration profiles, versus depth from the surface, of Pd, Ti and O of the titanium alloy of Inventive Example 4.
Figure 8:
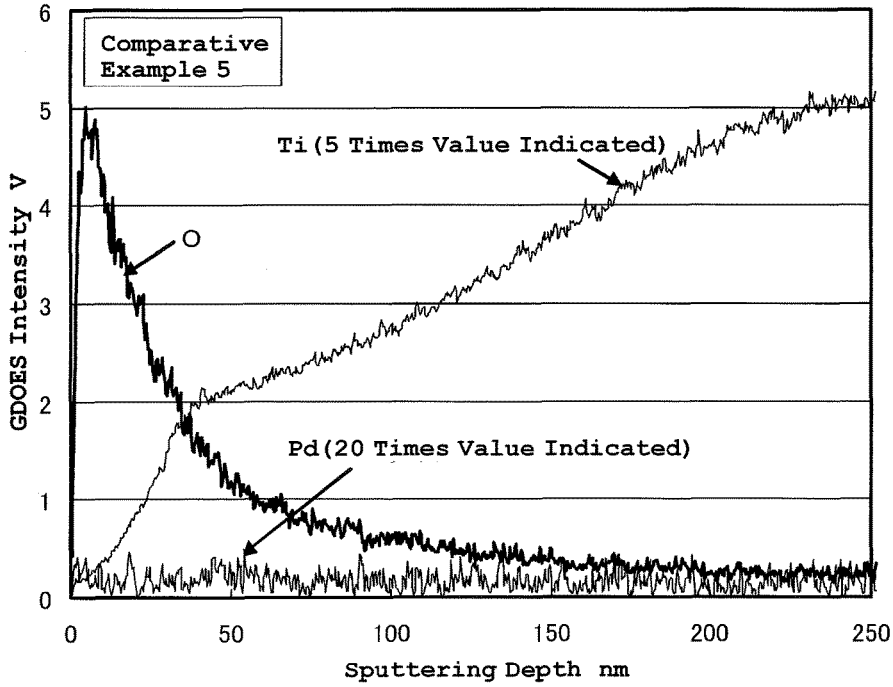
FIG. 8 is a graph illustrating concentration profiles, versus depth from the surface, of Pd, Ti and O of the titanium alloy of Comparative Example 5.

FIG. 7 and FIG. 8 are graphs illustrating concentration profiles, versus depth from the surface, of Pd, Ti and O of the titanium alloys of Inventive Example 8 and Comparative Example 5, respectively. In the figures, the concentration of each element is indicated by the intensity measured by the GDOES method.

As seen from FIG. 7, in the titanium alloy of Inventive Example 8 containing Y, a peak was observed indicating an accumulation of Pd near the surface. On the other hand, as seen from FIG. 8, no peak of Pd was observed for the titanium alloy of Comparative Example 5 that does not contain Y. From these observations, the following findings (1) and (2) were obtained.

(1) It is presumed that the presence of Y allows rapid dissolution of Ti and Pd at an early stage after exposure to a corrosive environment compared to the case where Y is not included, which results in an increased Pd ion concentration in hot hydrochloric acid near the outermost surface of the titanium alloy. Thus, deposition and accumulation of Pd on the surface of the titanium alloy progresses rapidly to thereby allow the titanium alloy as a whole to shift to the passivation potential within a short period of time. Accordingly, a titanium alloy formed with a platinum group metal and a rare earth metal is believed to exhibit better hot (boiling) hydrochloric acid resistance than a titanium alloy formed with a platinum group metal but not containing a rare earth metal.

(2) A comparison of the depth profiles of the Ti concentrations reveals the following. In the titanium alloy of Inventive Example 4, the alloy matrix composition (nearly 100% titanium) substantially resides immediately under the O and Pd accumulation layer of the surface throughout the entire alloy, except for a region up to a depth of 120 nm from the surface. This indicates that accumulation of Pd near the surface causes the titanium alloy as a whole to shift to a noble potential where the passivation of the surface is stably maintained. In contrast, in the titanium alloy of Comparative Example 5, the alloy matrix composition (nearly 100% titanium) substantially resides throughout the entire alloy except for a region up to a depth of 250 nm from the surface. This indicates that corrosion has developed inward from the surface in the depth direction.

Example 2

In Example 2, regarding the rare earth metal content of less than 0.02%, further detailed examinations were conducted for the crevice corrosion resistance and hot (boiling) hydrochloric acid resistance.

1. Test Conditions

1-1. Samples

The elemental compositions of the titanium alloys of the inventive examples and the comparative examples, used in Example 2, are listed in Table 3. Among these, the alloys of Inventive Example 8, Comparative Example 2, and Comparative Example 5 were also used in Example 1.

TABLE 3

| Classification | Alloy Composition (mass %, balance being Ti and impurities) Rare Earth Metal | Platinum Group Metal | Co | Remarks |
|---|---|---|---|---|
| Comparative Example 5 | — | Pd: 0.02 | — | No REM |
| Comparative Example 2 | Y: 4 ppm | Pd: 0.02 | — | REM: outside the specified range |
| Inventive Example 20 | Y: 11 ppm | Pd: 0.02 | — | |
| Inventive Example 21 | Y: 21 ppm | Pd: 0.02 | — | |
| Inventive Example 22 | Y: 40 ppm | Pd: 0.02 | — | |
| Inventive Example 8 | Y: 100 ppm | Pd: 0.02 | — | |
| Inventive Example 23 | Y: 190 ppm | Pd: 0.02 | — | |
| Inventive Example 24 | Y: 290 ppm | Pd: 0.02 | — | |
| Inventive Example 25 | Mm: 100 ppm | Pd: 0.02 | — | |
| Inventive Example 26 | Y: 50 ppm | Pd: 0.02 | 0.5 | |
| Inventive Example 27 | Y: 40 ppm | Pd: 0.01, Ru: 0.03 | — | |

The titanium alloys of Inventive Examples 8, and 20 to 27 all have a composition specified by the present invention. Among these, Inventive Example 25 contains Mm and Pd with no further compositional elements, Inventive Example 26 contains Y, Pd, and Co, Inventive Example 27 contains Y, Pd, and Ru, and the other inventive examples contain Y and Pd with no further compositional elements.

The titanium alloys of Comparative Examples 2 and 5 both have a composition specified by the present invention. Comparative Example 2 contains Y and Pd with no further compositional elements, and Comparative Example 5 contains Pd without containing Y. In Table 3, the symbol "-" indicates that the element was below detection limits.

Comparative Examples 5 and 2 as well as Inventive Examples 20 to 22, 8, 23, and 24 are materials used for investigation into the effects of the content of a rare earth metal (Y). Inventive Example 26 is a material used for investigation into the effects produced when a transition metal is included, and Inventive Example 27 is a material used for investigation into the effects produced by platinum group metals.

All the titanium alloys used in Example 2 were prepared using the same materials and by the same method as in Example 1.

1-2. Test Conditions

1-2-1. Crevice Corrosion Resistance Test and Hot (Boiling) Hydrochloric Acid Test In Example 2, the crevice corrosion resistance test and the hot (boiling) hydrochloric acid test were conducted under the same conditions as in Example 1.

1-2-2. Investigation into Variation in Pd Concentration Near Titanium Alloy Surface For the investigation into variation in Pd concentration near the titanium alloy surface, intensities measured by the GDOES method were used in Example 1. On the other hand, in Example 2, calibration curves of intensity versus concentration were generated through analysis of pure Ti, ASTM grade 17 (Ti-0.06 Pd), ASTM grade 7 (Ti-0.14 Pd), and pure Pd by the GDOES method so that approximate Pd concentrations on the titanium alloy surface can be computed. Since Ti and O are detected in addition to Pd on the titanium alloy surface, in Example 2, Pd concentrations corrected such that the total content of Ti, O, and Pd is 100% were used.

For Comparative Example 5, Inventive Examples 20 to 22, 8, 23 and 24, GDOES analysis was performed on each of them under the same conditions as those used in the generation of the calibration curves, and Pd concentrations on the titanium alloy surface were computed from the newly obtained calibration curves.

2. Test Results

Evaluation was made on the number of crevice sites attacked by corrosion, the mean corrosion rate, and the economic advantage as well as evaluation based on all these factors together. The results are shown in Table 4. The alloys of the inventive examples and comparative examples used in Example 2 were all rated as good (○) regarding the economic advantage.

TABLE 4

| Classification | Crevice Corrosion Resistance | Hot (Boiling) Hydrochloric Acid Resistance | | Economic | |
|---|---|---|---|---|---|
| | Number of Crevice Sites Attacked by Corrosion *1 | First 7-hour mean corrosion rate [mm/year] | 96-hour mean corrosion rate [mm/year] | Advantage (Material Cost considered) *2 | Surface Pd concentration [%] |
| Comparative Example 5 | 20 | 9.54 | 0.70 | ○ | 0.4 |
| Comparative Example 2 | 15 | 15.39 | 1.90 | ○ | — |
| Inventive Example 20 | 0 | 3.21 | 0.29 | ○ | 1.2 |
| Inventive Example 21 | 0 | 2.14 | 0.22 | ○ | 1.9 |
| Inventive Example 22 | 0 | 2.01 | 0.13 | ○ | 3.4 |
| Inventive Example 8 | 0 | 4.40 | 0.27 | ○ | 2 |
| Inventive Example 23 | 0 | 3.61 | 0.28 | ○ | 1.5 |
| Inventive Example 24 | 0 | 3.84 | 0.30 | ○ | — |
| Inventive Example 25 | 0 | 4.22 | 0.25 | ○ | — |
| Inventive Example 26 | 0 | 2.21 | 0.15 | ○ | — |
| Inventive Example 27 | 0 | 1.02 | 0.09 | ○ | — |

*1 Crevice corrosion resistance: evaluated based on the number of crevice sites attacked by corrosion (the number of crevice corrosion sites of all 40 crevice sites)
*2 Economic advantage: symbol "○" is assigned for Pd content of less than 0.05% or Ru content of 0.04%, and symbol "Δ" is assigned for Pd content of 0.05 to 0.15%

2-1. Crevice Corrosion Resistance

Table 2 includes evaluation of the crevice corrosion resistance indicated by the number of sites attacked by corrosion among 40 crevice sites formed by the multiple crevice assemblies. After the tests conducted under the above conditions, none of the inventive examples (Inventive Examples 8, and 20 to 27) suffered corrosion attack in any of the 40 crevice sites. Comparative Examples 2 and 5 both suffered corrosion attack. It is seen from these results that Y must be present in an amount of about 10 ppm in order to achieve high crevice corrosion resistance when the Pd content is 0.02%.

2-2. Hot (Boiling) Hydrochloric Acid Test

In Example 1, the inventive examples exhibited a low corrosion rate, with mean corrosion rates of 5 mm/year for the first 7 hours and of 0.3 mm/year for the 96 hours, respectively. In Example 2, investigation was made into the influence of the rare earth metal content on the 96-hour mean corrosion rate. Hot (boiling) hydrochloric acid resistance is closely related to crevice corrosion resistance.

Figure 9:
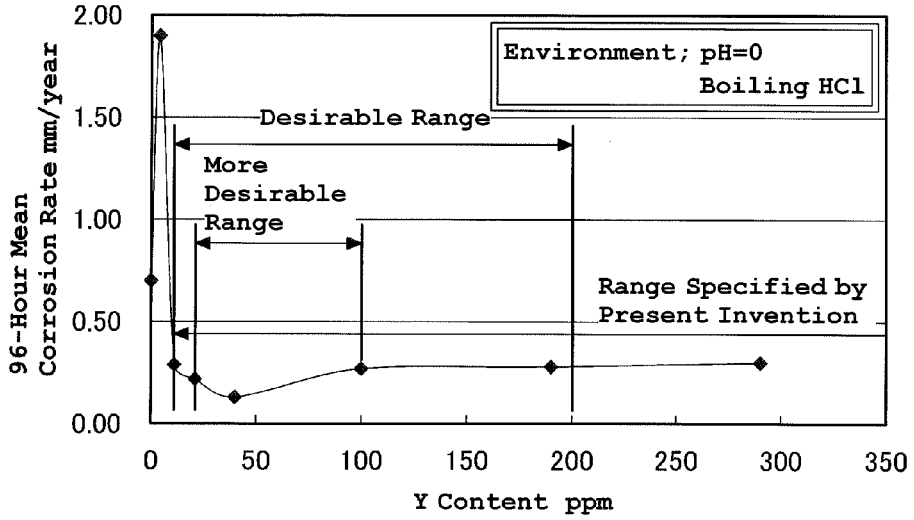
FIG. 9 is a graph illustrating the results of a hot (boiling) hydrochloric acid test. In the figure, FIG. 9(*a*) is a graph illustrating the relationship between the 96-hour mean corrosion rate and the Y content.
Figure 9:
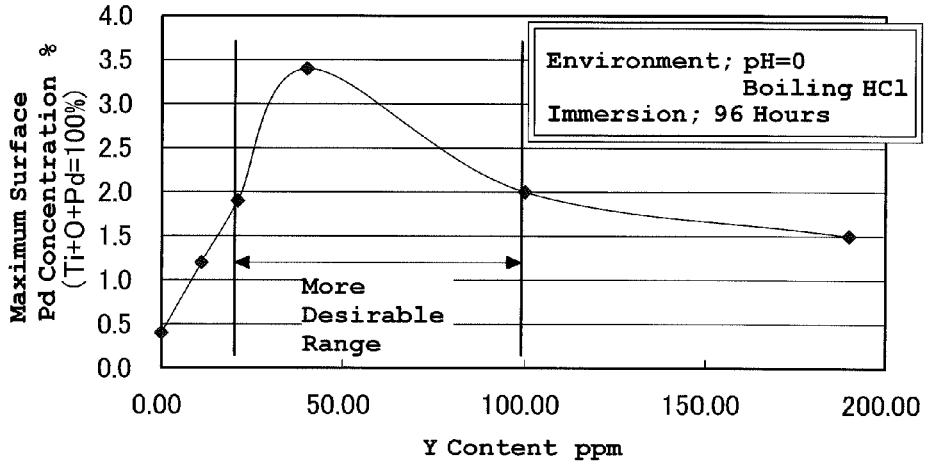

FIG. 9 is a graph illustrating the results of a hot (boiling) hydrochloric acid test. In the figure, FIG. 9(*a*) is a graph illustrating the relationship between the 96-hour mean corrosion rate and the Y content; and FIG. 9(*b*) is a graph illustrating the relationship between the surface Pd concentration after the test and the Y content. FIG. 9 shows compiled results of the cases in which the Y content is varied while the Pd content is constant at 0.02%.

2-3. Summary of Test Results

After studies of the test results of Example 2, the following findings (1) to (7) were obtained.

(1) The cases that satisfy the Y content of 0.001 to 0.10% specified by the present invention exhibited a good hot (boiling) hydrochloric acid resistance of 0.30 mm/year, as evaluated by the 96-hour mean corrosion rate (FIG. 9(*a*)).

(2) It is found that a preferred Y content is in the range of 10 ppm to 200 ppm, in which the mean corrosion rate is further decreased, and a more preferred Y content is in the range of 20 ppm to 100 ppm.

(3) In the concentration range of the Y content of 20 ppm to 100 ppm, the surface Pd concentration after the test was high (FIG. 9 (*b*)).

(4) Inventive Example 24 is a material having a Y content of 290 ppm, which is greater than the limit of the solid solubility of Y in Ti of about 200 ppm. Inventive Example 24 exhibited a hot (boiling) hydrochloric acid resistance of 0.30 mm/year in terms of the 96-hour mean corrosion rate. Although this is within the range of the present invention as shown in Example 1, it is the upper limit of the range. Inventive Example 23 having a Y content not exceeding the solid solubility limit exhibited a 96-hour mean corrosion rate of 0.28 mm/year. From these results, it is preferred that the Y content be no greater than the solid solubility limit of 200 ppm.

(5) In the case that includes a transition metal, which is an essential element of Patent Literatures 3 and 4, a small mean corrosion rate and thus high hot (boiling) hydrochloric acid resistance are achieved by the Y content of 50 ppm, which is no greater than the solid solubility limit (Inventive Example 26).

(6) In the case that includes a platinum group metal other than Pd, a small mean corrosion rate and thus high hot (boiling) hydrochloric acid resistance are also achieved by the Y content of no greater than 200 ppm (Inventive Example 27).

(7) In the case that includes a rare earth metal other than Y (Inventive Example 25 with 100 ppm Mm), a small mean corrosion rate and thus high hot (boiling) hydrochloric acid resistance are also achieved by the rare earth metal content of no greater than 200 ppm.

From the facts obtained in the above experiments, it is found that titanium alloys exhibit high corrosion resistance with the Y content of 0.001 to 0.10% as specified by the present invention, and even higher corrosion resistance if the Y content is limited to less than 0.02%.

INDUSTRIAL APPLICABILITY

The titanium alloy of the present invention has high corrosion resistance and good workability. Because of this, with the use of the titanium alloy of the present invention, it is possible to enhance performance and reliability of equipment and machinery that are used in corrosive environments (particularly in hot concentrated chloride environments). When the platinum group metal is included in relatively small amounts, the invention provides an advantage of more economical material costs for producing such titanium alloys. When the platinum group metal is included in relatively large amounts, the invention provides an advantage of less likelihood of corrosion growth originating at defects such as flaws that occurred in the surface.

REFERENCE SIGNS LIST

1: specimen, 2: multiple crevice assembly, 3: bolt, 4: nut (2) A comparison of the depth profiles of the Ti concentrations reveals the following. In the titanium alloy of Inventive Example 8, the alloy matrix composition (nearly 100% titanium) substantially resides immediately under the O and Pd accumulation layer of the surface throughout the entire alloy, except for a region up to a depth of 120 nm from the surface. This indicates that accumulation of Pd near the surface causes the titanium alloy as a whole to shift to a noble potential where the passivation of the surface is stably maintained. In contrast, in the titanium alloy of Comparative Example 5, the alloy matrix composition (nearly 100% titanium) substantially resides throughout the entire alloy except for a region up to a depth of 250 nm from the surface. This indicates that corrosion has developed inward from the surface in the depth direction.

What is claimed is:

1. A titanium alloy consisting of, by mass %, Pd as a platinum group metal: 0.01 to 0.15% and one or more selected from the group consisting of Y, La, Ce, Pr, and Nd as a rare earth metal: 0.001 to 0.0095%, with the balance being Ti and impurities, wherein, in a multiple crevice test, the titanium alloy does not suffer corrosion attack in any crevice site under a condition of 250 g/L NaCl, pH=2 adjusted with HCL, 150° C., saturated atmosphere, retained 240 hours.

2. A titanium alloy consisting of, by mass %, Pd as a platinum group metal: 0.01 to 0.15% and one or more selected from the group consisting of Y, La, Ce, Pr, and Nd as a rare earth metal: 0.001 to 0.0095%, with the balance being Ti and impurities, wherein Co is included, as a partial replacement for Ti, in an amount of 0.05 to 1.00% by mass, wherein, in a multiple crevice test, the titanium alloy does not suffer corrosion attack in any crevice site under a condition of 250 g/L NaCl, pH=2 adjusted with HCL, 150° C., saturated atmosphere, retained 240 hours.

3. A titanium alloy consisting of, by mass %, Ru as a platinum group metal: 0.01 to 0.15% and one or more selected from the group consisting of La, Ce, Pr and Nd as a rare earth metal: 0.001 to 0.0084%, with the balance being Ti and impurities, wherein, in a multiple crevice test, the titanium alloy does not suffer corrosion attack in any crevice site under a condition of 250 g/L NaCl, pH=2 adjusted with HCl, 150° C., saturated atmosphere, retained 240 hours.

4. A titanium alloy consisting of, by mass %, Ru as a platinum group metal: 0.01 to 0.15% and one or more selected from the group consisting of La, Ce, Pr and Nd as a rare earth metal: 0.001 to 0.0084%, with the balance being Ti and impurities, wherein Co is included, as a partial replacement for Ti, in an amount of 0.05 to 1.00% by mass, wherein, in a multiple crevice test, the titanium alloy does not suffer corrosion attack in any crevice site under a condition of 250 g/L NaCl, pH=2 adjusted with HCl, 150° C., saturated atmosphere, retained 240 hours.

* * * * *